US005575313A

United States Patent [19]

Weber et al.

[11] Patent Number: 5,575,313

[45] Date of Patent: Nov. 19, 1996

[54] APPARATUS FOR MONITORING A WARP YARN MOVEMENT IN A MULTI-PHASE WEAVING MACHINE

[75] Inventors: Thomas Weber, Feldmeilen; Dietmar Markward; Jaques Peulen, both of Rüti, all of Switzerland

[73] Assignee: Sulzer Rueti AG, Rueti, Switzerland

[21] Appl. No.: 419,889

[22] Filed: Apr. 11, 1995

[30] Foreign Application Priority Data

Apr. 22, 1994 [EP] European Pat. Off. ..... 94810223

[51] Int. Cl.[6] ..... D03D 51/28; B65H 63/032

[52] U.S. Cl. ..... 139/28; 139/353; 28/187; 66/163

[58] Field of Search ..... 66/164, 163; 139/353, 139/28; 28/187; 73/160

[56] References Cited

U.S. PATENT DOCUMENTS

| | | | |
|---|---|---|---|
| 4,072,935 | 2/1978 | Rydborn | 66/163 |
| 4,177,838 | 12/1979 | Van Wilson et al. | 139/353 |
| 4,372,346 | 2/1983 | Hutter | 139/353 |
| 4,872,488 | 10/1989 | Gryson et al. | 139/353 |
| 5,313,692 | 5/1994 | Mizuuchi et al. | 139/353 |

FOREIGN PATENT DOCUMENTS

| | | | |
|---|---|---|---|
| 0601920 | 12/1993 | European Pat. Off. | 139/194 |
| 1333993 | 7/1962 | France . | |
| 1492492 | 8/1967 | France . | |
| 1523985 | 5/1968 | France . | |
| 2421131 | 10/1979 | France . | |

OTHER PUBLICATIONS

Patent Abstracts of Japan, vol. 9, No. 322 (M–440) (2045), Dec. 18, 1985 & JP–A–60 157 463 (Mitsubishi Jukogyo) Aug. 17, 1985. Abstract.

*Primary Examiner*—Andy Falik
*Attorney, Agent, or Firm*—Townsend and Townsend and Crew LLP

[57] ABSTRACT

In a multi-phase weaving machine, an apparatus (16) for monitoring warp yarn movement (3*a*, 3*b*) in particular leno warp yarns. The drawing-off movement or the drawing-off speed of the warp yarns (3*a*, 3*b*) can be detected by an electronic sensor (6*a*, 6*b*; 6*c*) so that it can in particular be determined whether the drawing-off movement or the drawing-off speed has a very low or relatively large value. If the value is very low, in particular when the warp yarn is standing still while the weaving process is running, it can be concluded that the warp yarn has broken. If the value of the drawing-off speed lies above a preset threshold value it can be concluded that the warp yarn is being driven in an undesired manner so that an error signal (13) is produced in order to interrupt the weaving process.

6 Claims, 3 Drawing Sheets

APPARATUS FOR MONITORING A WARP YARN MOVEMENT IN A MULTI-PHASE WEAVING MACHINE

BACKGROUND OF THE INVENTION

The present invention relates to an apparatus for monitoring a warp yarn, in particular a leno warp yarn. The invention relates further to weaving machines having an apparatus in accordance with the invention.

One or more leno selvedges can be produced at the edges of a fabric with warp yarns via a leno weave in order to provide a strengthened edge to the fabric. These warp yarns, which are also termed leno warp yarns, are customarily guided and monitored separately from the other warp yarns. It is known to monitor breakage of a warp yarn with a warp stop motion by detecting whether a warp yarn is present or not.

In certain weaving processes or weaving machines, such as, for example, in multiphase weaving machines with a weaving rotor, the problem arises that a warp yarn or a leno warp yarn can be caught by the rotating weaving rotor and wound onto the weaving rotor without breaking the warp yarn or the leno warp yarn. Known warp stop motions are not able to detect such faults.

SUMMARY OF THE INVENTION

The object of the present invention is to improve an apparatus for monitoring a warp yarn, in particular a leno warp yarn, in such a manner that it has improved properties in relation to the monitoring of the warp yarn.

The present invention is directed to a multi-phase weaving machine of the type having a weaving rotor for driving a plurality of leno warp yarns in a drawing-off direction. The invention is a detection arrangement operatively coupled to the weaving rotor for detecting movement of at least one of the leno warp yarns in a drawing-off direction. The detection arrangement includes an electronic scanner configured to scan the leno warp yarns and to determine whether the warp yarn speed is below and above threshold values.

The advantages of the invention are to be seen in the fact that the drawing-off movement or the drawing-off speed of the warp yarn can be approximately or exactly detected with an electronic sensor. In particular, it can be determined whether the drawing-off movement or the drawing-off speed has a very low or a very high value. If the value is very low, in particular when the warp yarn is not moving when the weaving process is running, it can be concluded that the warp yarn has broken. If the value of the drawing-off speed lies above a predetermined threshold value, it can be concluded that the warp yarn has become caught and is being driven in an undesired manner so that an error signal is produced in order to interrupt the weaving process.

Together with the methods described in the embodiments, there is a large number of possibilities to monitor the drawing-off movement or the approximate speed of a yarn, for example optical correlation measurements, capacitive measurements, measurements with lasers etc.

The electronic signals of the sensors are supplied to a signal processing apparatus which can include digital or analog evaluation electronics (e.g., also a microprocessor) in order to compare a measured value with a presettable reference value, and, when this reference value is exceeded or fallen short of, to produce an error signal which is conveyed to a master unit, for example, to stop a weaving machine.

BRIEF DESCRIPTION OF THE DRAWINGS

In the following the invention will be described in detail by way of example only and with the aid of the embodiments shown in the figures. The figures show.

DESCRIPTION OF THE SPECIFIC EMBODIMENTS

Figure 1:
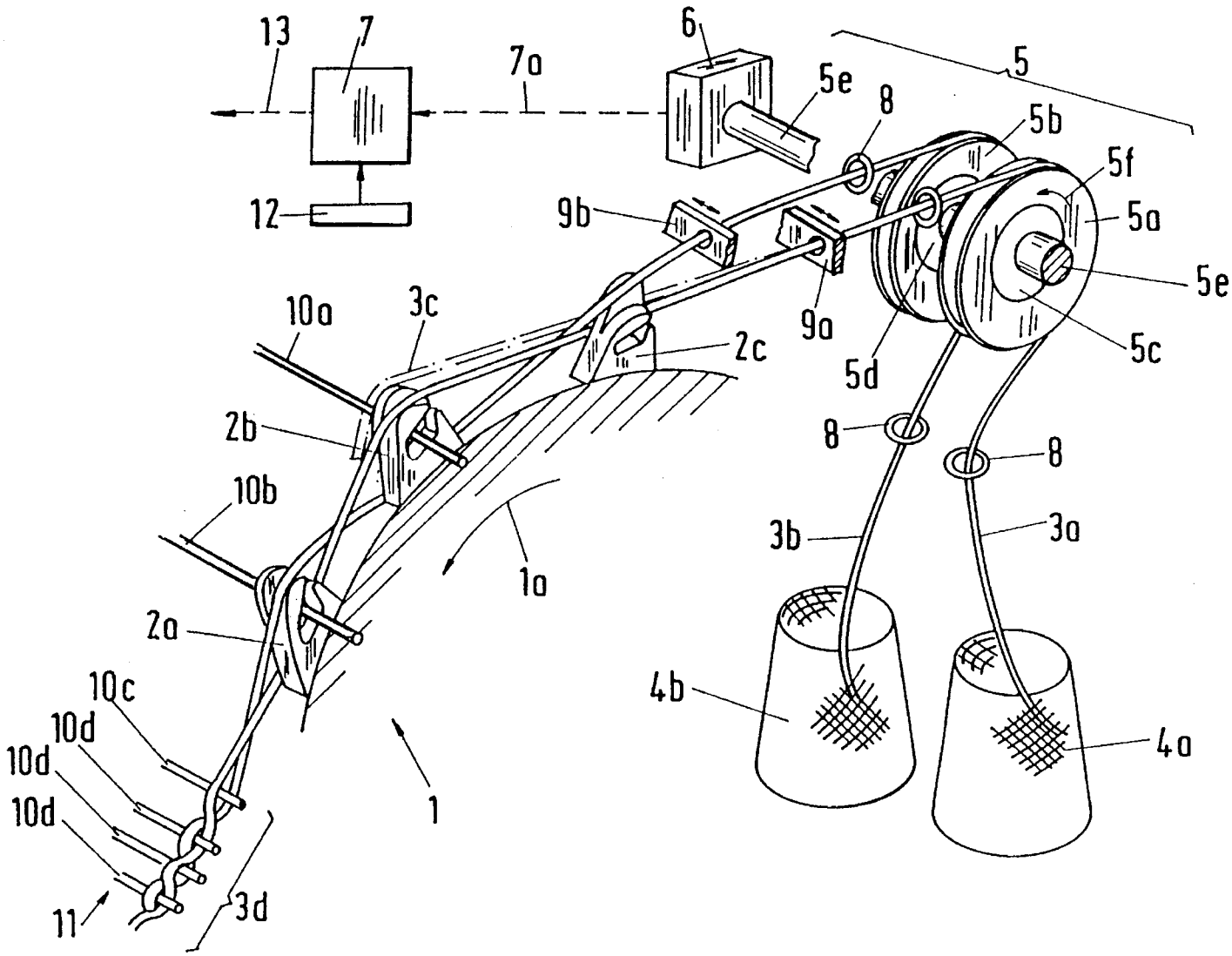
FIG. 1 is a schamatic view of an apparatus for monitoring a warp yarn on a series-shed weaving machine.

FIG. 1 shows the apparatus of the invention in conjunction with a series-shed weaving machine having a weaving rotor rotating in the direction of rotation 1*a*. The rotor 1 has guide elements 2*a*, 2*b*, 2*c* into which the warp yarns 3*a*, 3*b* are placed by means of what is traditionally called a laying-in apparatus 9*a*, 9*b* but for a series-shed weaving machine is better described as a guiding-in apparatus. The guiding-in apparatus guides the warp threads into the guide elements 2*a*, 2*b*, 2*c* in an alternating manner to form a series of open sheds into which the weft yarns 10*a*, 10*b* can be inserted. The guiding-in apparatus 9*a*, 9*b* controls the guiding in of the warp yarns 3*a*, 3*b* in such a way that a selvedge 3*d* forms at the edge of the cloth 11 which includes the weft (or pick) yarns 10*c*, 10*d*. In the present embodiment, an arrangement 5 for detecting motion of the warp yarns 3*a*, 3*b* comprises a yarn roller 5*a*, 5*b* for each warp yarn 3*a*, 3*b* on which the warp yarn 3*a*, 3*b* lies and which experience a rotation in the direction of rotation 5*f* due to the warp yarns 3*a*, 3*b* moving in the direction of the cloth 11. The two yarn rollers 5*a*, 5*b* are mounted on a common axle 5*e* via a coupling part, for example a free wheel clutch or a sliding clutch 5*c*, 5*d*. The axle 5*e* is connected to an electronic sensor 6 which detects the rotation of the axle 5*e* and conveys the electronic signal to a signal processing apparatus 7 via a signal line 7*a*. Eyelets 8 serve for guiding the warp yarns 3*a* 3*b* onto the yarn rollers 5*a*, 5*b* and to provide an approximately constant wrap-round angle. The yarn rollers 5*a*, 5*b* can, as shown, be wrapped around by only a fraction of a complete circle, or can also be wrapped around several times in order to thereby increase the friction between the warp yarns 3*a*, 3*b* and the yarn rollers 5*a*, 5*b*. The apparatus of FIG. 1 has the advantage that a single sensor is capable of simultaneously monitoring a plurality of warp yarns. FIG. 1 does not show braking devices which, in certain conditions, are necessary in order to effect a braking force onto the warp yarns 3*a*, 3*b*, for example between the yarn supplies 4*a*, 4*b* and the yarn rollers 5*a*, 5*b*.

The angular speed of the weaving rotor 1 in the direction of rotation l*a* during weaving is substantially higher than the speed of the movement of the warp yarns 3*a*, 3*b* in the direction of the cloth 11. If a fault occurs when guiding a warp yarn 3*a*, 3*b* into a guide element 2*a*, 2*b*, 2*c*, as is for instance shown by by warp yarn 3*c*, then it can transpire that the warp yarn 3*c* is caught by the guide element 2*b* and thereby accelerated to a speed determined by the angular speed of the weaving rotor 1. If such an acceleration occurs with one or both of the crossing yarns 3*a*, 3*b*, then the rotational speed of the common axle 5*e* accelerates, so that the occurrence of a fault of this kind is detectable by the sensor 6. The signal processing apparatus 7 can be given a threshold value 12 so that when this threshold value is exceeded or fallen short of the signal processing apparatus 7 produces an error signal, for example in order to stop the weaving rotor 1.

If a separate sensor 6 for detecting the rotation is provided for each yarn roller 5*a*, 5*b*, the arrangement 5 is also capable of detecting a yarn breakage. If, during weaving, the angular speed falls below a certain reference value as can for example occur when a yarn roller 5*a*, 5*b* is not moving, it can be concluded from this that a breakage of the warp yarn 3*a*, 3*b* has occurred, or that the yarn supply 4*a*, 4*b* is used up.

Figure 2:
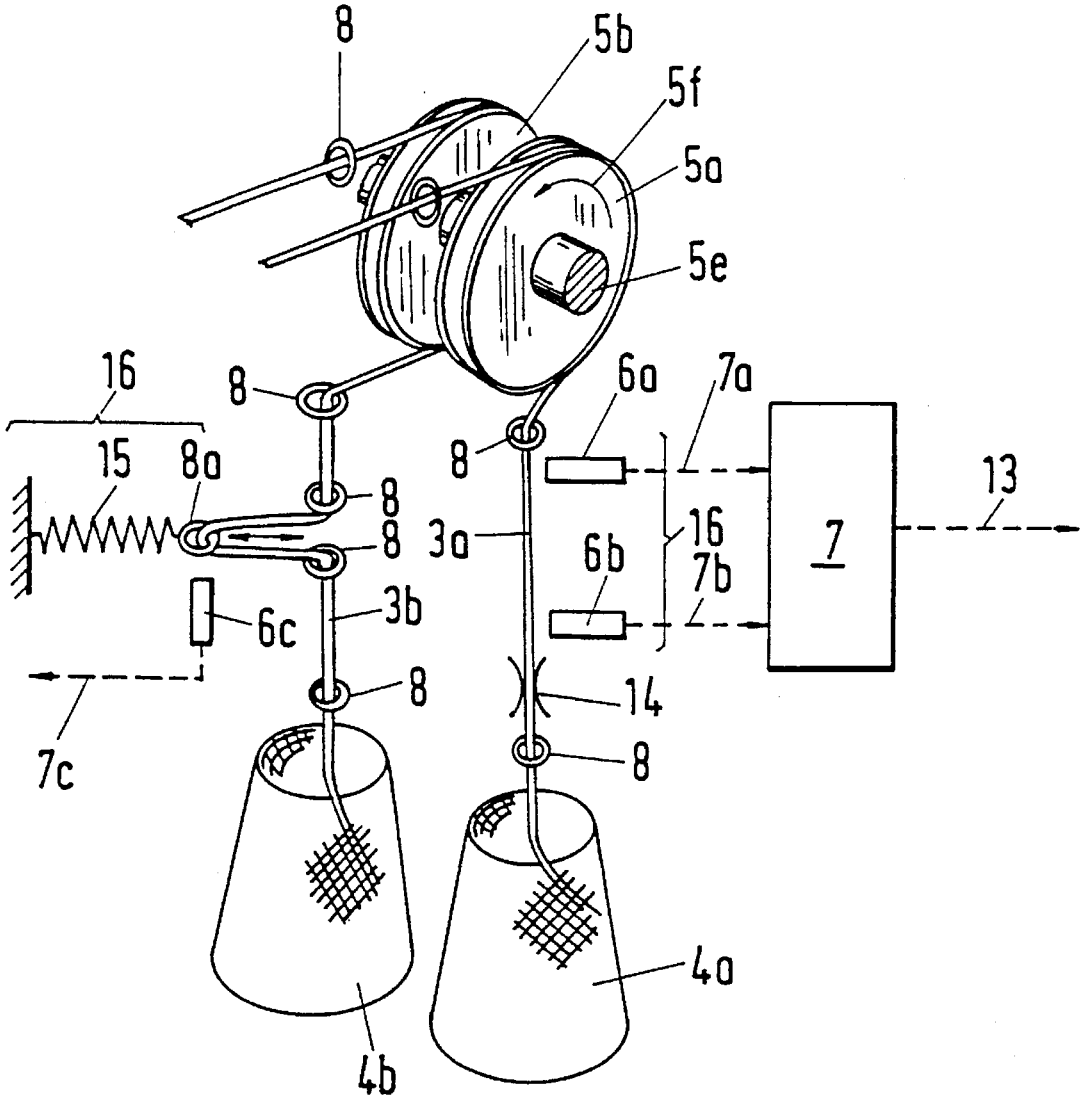
FIG. 2 is an enlarged, schematic view of another apparatus for monitoring a warp yarn of a weaving machine.

FIG. 2 shows further embodiments of apparatuses for determining the speed of a warp yarn. The arrangement 16 comprises two sensors 6*a*, 6*b* which are separated in the running direction of the warp yarn 3*a* and which monitor the warp yarn 3*a*. The electronic signals of the sensors 6*a*, 6*b* are supplied via signal lines 7*a*, 7*b* to a signal processing apparatus 7 which determines the speed of the warp yarn 3*a* by correlating the measured values. The part of the warp yarn 3*a* lying between the two sensors 6*a*, 6*b* is guided through eyelets 8 along a line which is as straight as possible, the warp yarn 3*a* being held stretched out by a yarn brake 14 acting on the warp yarn 3*a*. The warp yarn 3*a* is fed around a yarn roller 5*a* and supplied to a weaving machine. The sensors 6*a*, 6*b* are based for example on an optical or capacitive measurement principle. A suitable description of this principle can be found in European Patent Publication No. 601,920-A1, the complete disclosure of which is hereby incorporated herein by reference.

A further arrangement 16 for determining the speed of the warp yarn 3*b* comprises three eyelets 8, 8*a* in order to deflect or deviate the warp yarn in the shape of a "U " wherein the eyelet 8*a* formed as a holding means is connected via an elastic element, for example a spring 15, to a fixed body. The eyelet 8*a* experiences a deflection which depends on the speed of the warp yarn 3*b* and which is detectable by a sensor 6*c*, for example an optical sensor or a path sensor, and is supplied via a signal line 7*c* to a signal processing apparatus 7.

The arrangement 16 also allows a jolt-like deflection of the warp yarn 3*b* to be detected.

Figure 3:
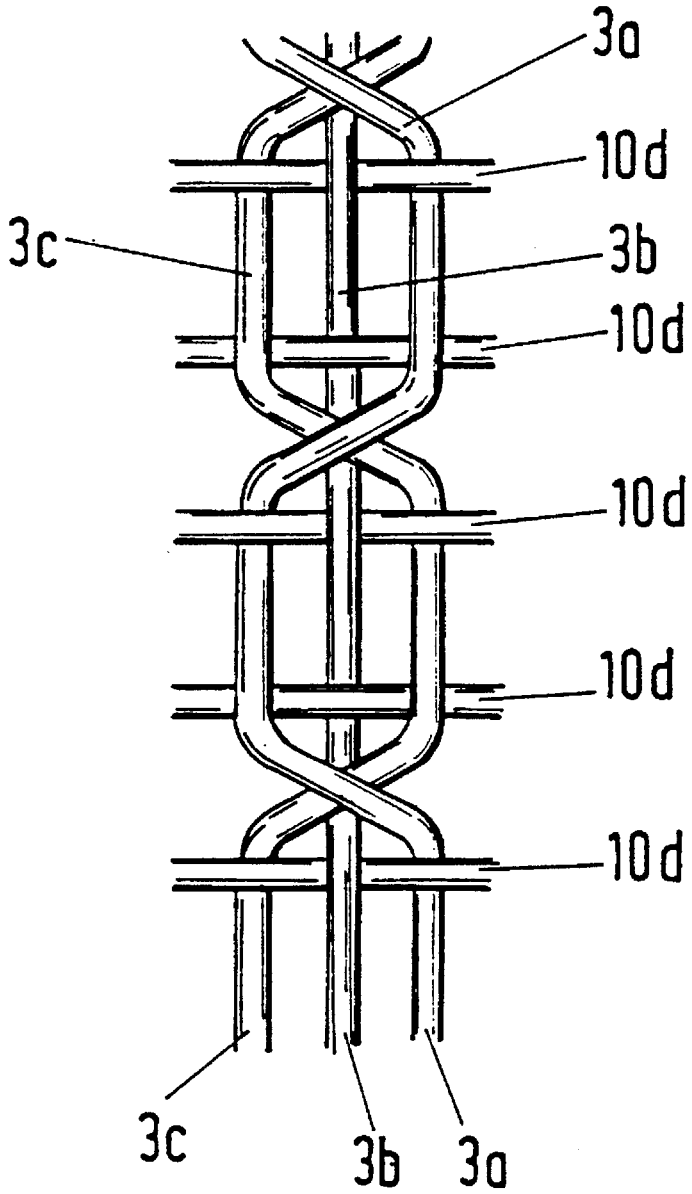
FIG. 3 is an enlarged view of a leno weave consisting of warp yarns.

FIG. 3 shows an example of a leno weave consisting of three warp yarns 3*a*, 3*b*, 3*c* which can be produced with a series-shed weaving machine in accordance with figure 1 when three warp yarns 3*a*, 3*b*, 3*c* controlled by guiding-in apparatuses 9*a*, 9*b* are used. The number of warp yarns necessary depends on the type of auxiliary selvedge which is to be produced. In the present leno weave, the warp yarns 3*a*, 3*b*, 3*c* are nipped differently from one another, the warp yarns 3*a*, 3*c* being termed leno warp yarns and the warp yarn 3*b* being termed a stationary thread.

We claim:

1. A multi-phase weaving machine comprising:

a weaving rotor for driving a plurality of leno warp yarns in a drawing-off direction; and a detection arrangement for detecting movement of at least one of the leno warp yarns in the drawing-off direction, the arrangement comprising an electronic scanner.

2. The weaving machine of claim 1 wherein the detection arrangement comprises an electronic scanner associated with each leno warp yarn.

3. The weaving machine of claim 1 wherein the electronic scanner comprises means for detecting a speed of said one of the leno warp yarns.

4. The weaving machine of claim 3 wherein the detection arrangement further comprises a signal processor coupled to the electronic scanner, the signal processor producing an error signal when the speed of said one of the leno warp yarns exceeds a threshold value.

5. The weaving machine of claim 1 wherein the arrangement comprises a common axle and at least one yarn roller connected to the common axle, the electronic scanner detecting the rotational speed of the common axle.

6. The weaving machine of claim 1 wherein the arrangement comprises an elastic holding device for receiving the leno warp yarns and a sensor operatively coupled to the holding device, the holding device being deflected by the leno warp yarns and the sensor detecting the deflection of the holding device to determine a speed of the leno warp yarns.

* * * * *